United States Patent [19]

Liautaud

[11] 3,998,274

[45] Dec. 21, 1976

[54] FIRE EXTINGUISHER HEAD ASSEMBLY

[76] Inventor: James P. Liautaud, River and Bluff Road, Trout Valley, Cary, Ill. 60013

[22] Filed: May 15, 1975

[21] Appl. No.: 577,937

[52] U.S. Cl. ..... 169/89; 222/464

[51] Int. Cl.[2] ..... A62C 13/00

[58] Field of Search ..... 169/89, 71, 74, 77, 169/89, 88; 222/394, 464; 220/288; 277/165; 251/DIG. 1

[56] References Cited

UNITED STATES PATENTS

| | | | |
|---|---|---|---|
| 2,083,584 | 6/1937 | Wineman | 251/DIG. 1 |
| 2,616,512 | 11/1952 | Coon | 251/DIG. 1 |
| 2,926,731 | 3/1960 | Bowman et al. | 169/89 X |
| 3,530,941 | 9/1970 | Hansen et al. | 169/89 |
| 3,662,836 | 5/1972 | Siimes | 169/89 |
| 3,667,549 | 6/1972 | Sachs et al. | 169/74 X |

FOREIGN PATENTS OR APPLICATIONS

| | | | |
|---|---|---|---|
| 1,091,327 | 4/1955 | France | 251/DIG. 1 |

*Primary Examiner*—John J. Love
*Assistant Examiner*—Michael Mar
*Attorney, Agent, or Firm*—Lockwood, Dewey, Zickert & Alex

[57] ABSTRACT

A head assembly for a portable fire extinguisher includes a plastic injection-molded body adapted to fit over the discharge opening of a pressurized cylinder of fire extinguishing agent. The body includes an internal passageway in which a valve is slidably mounted. An O-ring embedded in the wall of the passageway serves as a valve seat for the valve to provide control of the dispensing of the extinguishing agent. A tube segment, one end of which is flared and molded into the housing, and the other end of which extends through the discharge opening and is attached to the cylinder by a threaded sleeve, serves to mount the head assembly to the cylinder. In an alternate embodiment, the body of the head assembly includes a handle symmetrically disposed with respect to the center of gravity of the fire extinguisher for improved portability.

17 Claims, 14 Drawing Figures

FIRE EXTINGUISHER HEAD ASSEMBLY

BACKGROUND OF THE INVENTION

This invention relates generally to fire extinguishers, and more particularly to an improved head assembly for use with a portable fire extinguisher wherein a pressurized gas such as carbon dioxide is used as the extinguishing agent.

In the usual fire extinguisher construction a metal container or cylinder is filled with a quantity of a fire extinguishing agent, such as carbon dioxide or Freon, under pressure. The container is fitted with a removable head assembly which includes a user-actuable valve for controlling the dispensing of the pressurized gas, and which also may include a handle for carrying the extinguisher and a dispersal horn for directing the extinguishing agent in a desired direction.

Prior art head assemblies for fire extinguishers have been unnecessarily expensive and heavy, primarily because of their use of a metal body and the high manufacturing costs attendant therewith. Prior art attempts at manufacturing head assemblies having bodies formed from less expensive materials, such as injection-molded plastic, have not been entirely successful, primarily because the relatively heavy steel cylinders in which the extinguishing agents are contained have caused the plastic bodies of such assemblies to crack or deform when transported, thereby destroying the pressure seal between the assemblies and the cylinders.

Prior art fire extinguishers have also been awkward to use by reason of their handles not being centered with respect to the center of gravity of the extinguishers. As a result the user of such extinguishers has been subjected to a twisting moment in attempting to aim the extinguisher, making use of the extinguishers unnecessarily difficult and tiring.

Accordingly, it is a general object of the present invention to provide a new and improved head assembly for a portable fire extinguisher.

It is another object of the present invention to provide a head assembly for a fire extinguisher which is lighter in weight and more economical to manufacture than prior art designs.

It is another object of the present invention to provide a head assembly for a fire extinguisher which is more convenient and less tiring to use.

SUMMARY OF THE INVENTION

The invention is directed, in a fire extinguisher of the type having a pressurized fluid container having a neck opening therein, to a head assembly comprising a body member molded of a plastic material, the body member including a passageway having a valve seat disposed therein, and a valve member slidably disposed within the passageway, the valve member coacting with the valve seat to restrict the flow of the fluid through the passageway. A handle and user-actuable trigger means are provided for forcing the valve member away from the valve seat to dispense the fluid product through the passageway. Means including a tube segment formed of a relatively high strength material are provided for establishing fluid communication between the passageway and the interior of the container, one end of the tube segment being molded into the body member and the other end extending through the neck opening and into the interior, fastening means being provided on the tube segment for establishing a mechanically rigid pressure-sealed engagement between the tube segment and the container.

The invention is further directed, in a fire extinguisher of the type having a pressurized fluid container having a neck opening therein, to a head assembly comprising a body member molded of a plastic material, the body member including a passageway disposed for communication with the interior of the container, and a valve member slidably disposed within the passageway. Means including an O-ring valve seat concentrically embedded in the wall of the passageway are provided for coacting with the valve member to restrict the flow of the fluid through the passageway, user-actuable trigger means are provided for forcing the valve member away from the valve seat to dispense the fluid product through the passageway, and means are provided for mounting the body member to the container.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which:

DESCRIPTION OF THE PREFERRED EMBODIMENT

Figure 1:
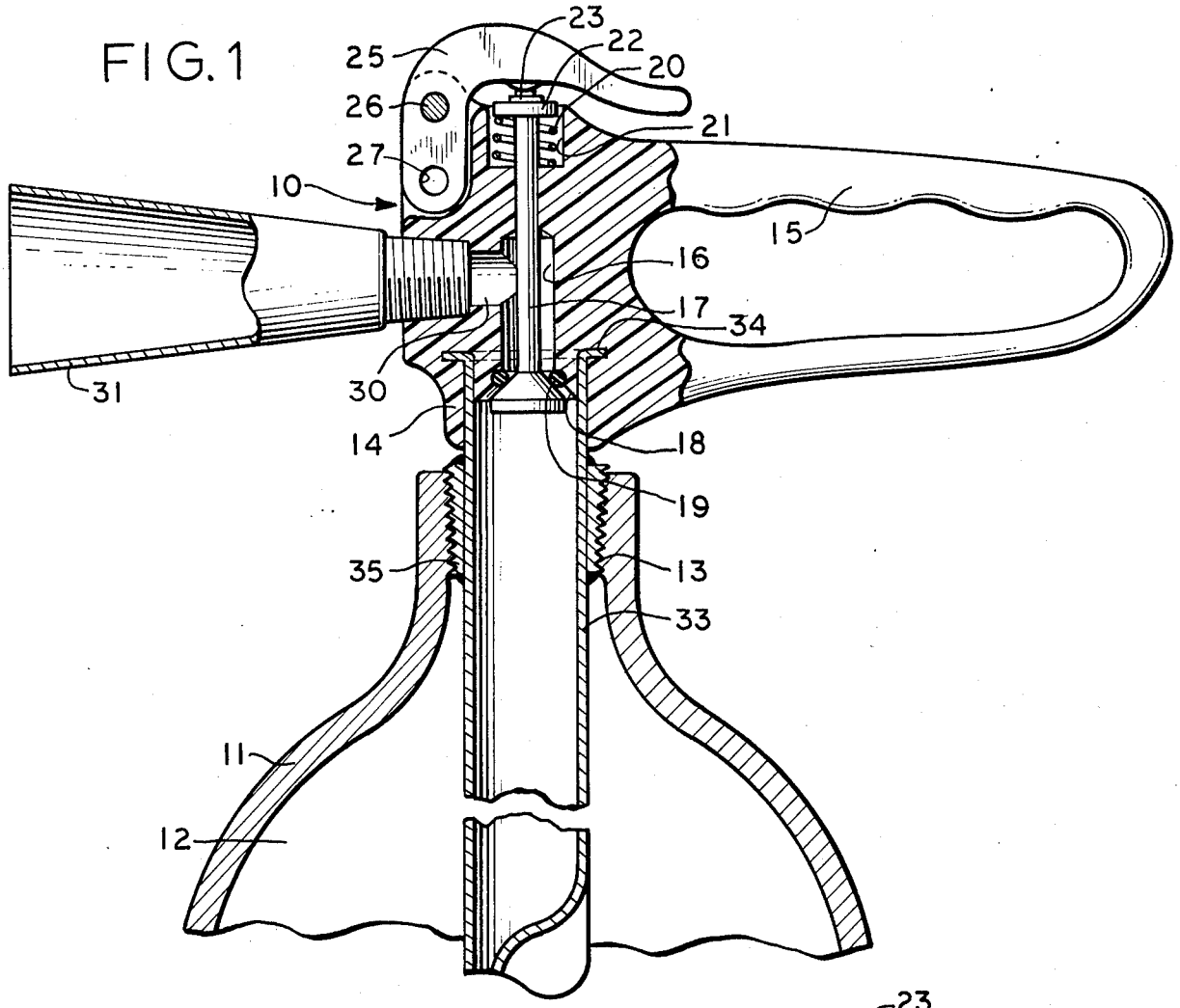
FIG. 1 is an enlarged side elevational view, partially in cross section, of the head assembly of a fire extinguisher constructed in accordance with the present invention.

Referring now to the drawings, and particularly to FIG. 1, there is shown a fire extinguisher head assembly 10 constructed in accordance with the invention. The head assembly is installed on a steel container or cylinder 11, the interior 12 of which is filled with a fire extinguishing agent under pressure, such as carbon dioxide or Freon. In accordance with conventional design practice, the cylinder necks down at its top end to an internally-threaded opening 13 to which the head assembly is attached.

The fire extinguisher head assembly includes a body 14 injection-molded of plastic or other similar material. A handle 15 is integrally molded into the body to provide means for carrying and aiming the fire extinguisher. To control the dispensing of the fire extinguishing agent from cylinder 11, the body 14 is also provided with an internal passageway 16 within which a valve member 17 is slidably mounted. The valve member includes a frusto-conical valve portion at its bottom end and a stem portion at its top end. The side wall of passageway 16 is inwardly tapered near its bottom end to form a surface 18 against which the frusto-conical valve portion of valve member 17 can seat to seal the passageway.

In accordance with one aspect of the invention the sealing action of valve member 17 is enhanced by the provision of an annular O-ring 19 embedded into housing 14 along the tapered surface 18 of passageway 16. This O-ring valve seat is preferably inserted during the molding operation and as such is permanently embedded in the head body. During storage valve member 17 is maintained in a seated position with the tapered surface of its frusto-conical valve portion bearing against O-ring 19 by means of a helical compression spring 20 concentrically disposed around the stem portion of the valve member. Spring 20 is contained within a recess 21 molded into body 14 at the top end of passageway 16, and is maintained in compression by means of a washer 22 and a C-clip 23 fitted over a notch 24 (FIG. 3) at the top end of the valve stem.

In use, valve member 17 is actuated to its open position by means of a lever 25, which is pivotably mounted to the top surface of housing 14 by means of a pin 26. When the end of lever 25 is depressed, the stem of valve 17 is forced downwardly and the frusto-conical valve portion of the valve member is unseated, allowing the pressurized fire extinguishing agent to flow upwardly along passageway 16. To prevent inadvertent actuation of lever 25, a pull-pin (not shown) is normally inserted through an opening 27 in the valve body, which is aligned with a similar opening in lever 25.

Upline of valve seat 18 passageway 16 has a larger diameter than the stem of valve member 17 to allow the fire extinguishing agent to flow into a passageway 30 arranged at right angles to passageway 16. Beyond passageway 30 passageway 16 has a diameter approximating that of the valve stem to prevent the pressurized extinguishing substance from escaping upwardly along the stem. Passageway 30 communicates with a cone-shaped dispersal horn 31 which serves to direct the extinguishing agent onto a desired area. The dispersal horn is preferably removably attached to housing 14 by means of an extremely threaded portion at its narrow end which is turned into a complementary threaded portion of passageway 30.

In accordance with another aspect of the invention the body 14 of head assembly 10 is joined to cylinder 11 by means of a tube segment 33 formed of heavy gauge steel or other high strength material. The top end of this tube segment is outwardly flared to form a flange 34 which is securely attached to housing 14 by reason of being embedded therein during the injection molding process. The tube segment 33 is axially aligned with passageway 16, and the interior of the tube communicates with the passageway to form a flow path for the fire extinguishing agent in the cylinder. Tube 33 extends through the neck opening 13 of cylinder 11 and is sealably attached to the wall of the cylinder by means of an externally threaded sleeve 35 soldered to its outside surface. The threads on this sleeve coact with the internal threads of opening 13 to provide a pressure sealed mounting for head assembly 10. By reason of tube segment 33 being formed of a high strength material such as steel, and by reason of its upper end being flanged and embedded in housing 14, a strong mechanical connection is established between head assembly 10 and cylinder 11.

While a heavy gauge metallic material is preferred for conduit 33, it will be appreciated that certain other materials, such as very hard plastics, may be employed instead. Also, it will be appreciated that it would be possible in certain instances to thread the outside surface of conduit segment 33, thus eliminating the need for sleeve 35. Furthermore, while the conduit and passageway are shown in axial alignment, in certain applications it may be advantageous to have passageway 16 and valve member 17 at an angle to the conduit, the only requirement then being that the two elements be maintained in fluid communication.

Figure 2:
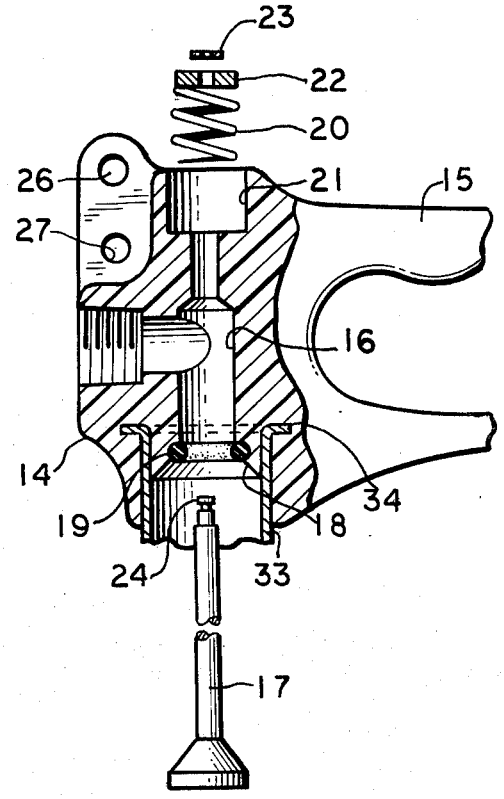
FIG. 2 is an enlarged exploded perspective view of the head assembly.

Referring to FIG. 2, assembly of the head assembly is accomplished by inserting valve 17 into passageway 16. Washer 22 and spring 20 are then inserted over the stem of the valve and C-clip 23 is press-fit over notch 24 to retain the spring in position. The actuator lever 25 (FIG. 1) is next placed in position and pin 26 is inserted to establish a pivotal mounting for the lever. A safety pin may be inserted at this time through aperture 27 to prevent inadvertent actuation of the actuator lever.

Figure 3:
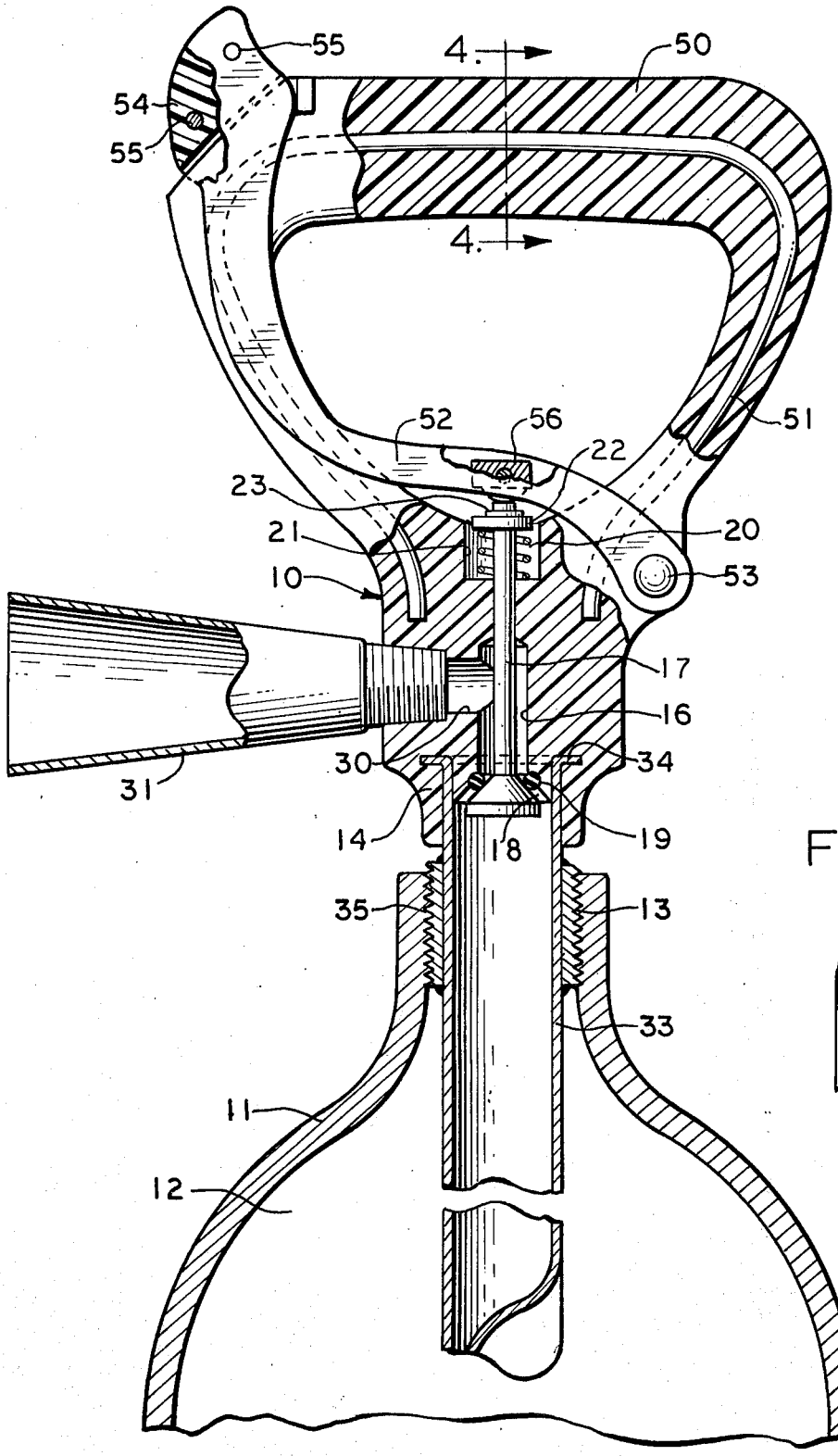
FIG. 3 is an enlarged side elevational view of the head assembly showing an alternate construction for the handle.
Figure 4:
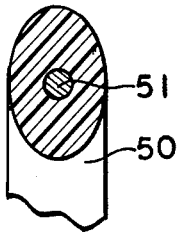
FIG. 4 is a cross-sectional view taken along line 4—4 of FIG. 3.

Referring to FIGS. 3 and 4, in accordance with another aspect of the invention, a handle 50 symmetrically-disposed with respect to the center of gravity of the combined head assembly and cylinder may be provided in conjunction with head assembly 10. The advantage of this symmetrical handle arrangement is that the weight which must be supported by the user is balanced, allowing the user to more easily transport the fire extinguisher and enabling the fire extinguisher to be more easily manipulated and aimed during use.

Like the asymmetrically-disposed handle 15 shown in FIGS. 1–2, handle 50 may be integrally molded with housing 14. In FIG. 3 handle 50 is shown as a closed loop symmetrically disposed with respect to the axis of cylinder 11, the weight of housing 14 and dispersal horn 22 being negligible compared to the weight of the cylinder. A wire-like reinforcing member 51 may be provided through the center of the handle to provide additional mechanical strength.

To provide for convenient control of the fire extinguisher while being held in one hand housing 14 is fitted with an actuator means in the form of a pair of curved arms 52 pivotably mounted on either side of handle 50 by means of a pin 53 to housing 14. The ends of levers 52 may be connected together by means of a spacer block 54 and a pair of rivets 55 to provide a convenient actuating surface against which the user can press his thumb. The levers 52 are joined by another actuator block 56 which bears down on the top end of the stem of valve 17.

Thus, a head assembly for a fire extinguisher has been shown which provides reliable operation combined with economy of manufacture. The head assembly utilizes a minimum number of parts and incorporates an injection-molded body which may be economically formed by conventional injection-molding techniques.

While two embodiments of the invention have been shown and described, it will be obvious to those skilled in the art that changes and modifications may be made without departing from the invention in its broader aspects and, therefore, the aim in the appended claims is to cover all such changes and modifications as fall within the true spirit and scope of the invention.

I claim:

1. In a fire extinguisher of the type having a pressurized fluid container having a neck opening therein, a head assembly comprising, in combination:

a body member molded of a plastic material, said body member including a passageway having a valve seat disposed therein;

a valve member slidably disposed within said passageway, said valve member coacting with said valve seat to restrict the flow of said fluid through said passageway;

user-actuable trigger means for forcing said valve member away from said valve seat to dispense said fluid product through said passageway;

a handle;

means including a tube segment formed of a relatively high strength material for establishing fluid communication between said passageway and the interior of said container, one end of said tube segment being molded into said body member and the other end extending through said neck opening and into said interior; and fastening means on said tube segment for establishing a mechanically rigid pressure-sealed engagement between said tube segment and said container.

2. A head assembly for a fire extinguisher as defined in claim 1 wherein said end portion of said tube segment is outwardly flared to provide a mechanically secure attachment to said valve housing.

3. A head assembly for a fire extinguisher as defined in claim 1 wherein said neck opening is internally threaded, and wherein said fastening means include an externally threaded portion on said tube segment.

4. A head assembly as defined in claim 3 wherein said externally threaded portion comprises an externally threaded collar received over the outside surface of said tube segment.

5. A head assembly for a fire extinguisher as defined in claim 1 wherein said valve seat comprises an O-ring embedded into the wall of said passageway for engaging said tapered valve portion.

6. A head assembly for a fire extinguisher as defined in claim 1 wherein said passageway and said tube segment are axially aligned with said neck opening, said valve stem extends along said passageway, and said trigger means are operatively engaged to said stem portion.

7. A head assembly as defined in claim 1 wherein said valve member includes a tapered valve portion and an elongated stem portion, and wherein a helical spring is concentrically disposed around said stem portion for biasing said valve member into a seated position, said passageway includes an enlarged portion on the surface of said valve housing for accommodating said spring, and wherein spring retaining means are provided on said valve stem for maintaining said spring in compression.

8. A head assembly as defined in claim 1 wherein said conduit is formed of a metallic material.

9. A head assembly as defined in claim 1 wherein said handle portion is substantially symmetrically disposed with respect to the center of gravity of said fire extinguisher.

10. A head assembly as defined in claim 9 wherein said handle portion is in the form of a loop extending between opposite sides of said valve housing.

11. A head assembly as defined in claim 1 wherein said handle portion is integrally molded with said valve housing.

12. A head assembly as defined in claim 11 wherein said handle portion includes an internal reinforcing element.

13. A valve assembly for use in conjunction with a pressurized fluid container having a neck opening therein, comprising, in combination:

a body member molded of a plastic material, said body member including a passageway having a valve seat disposed therein;

a valve member slidably disposed within said passageway, said valve member coacting with said valve seat to restrict the flow of said fluid through said passageway;

trigger means responsive to an applied control effect for forcing said valve member away from said valve seat to dispense said fluid product through said passageway;

means including a tube segment formed of a relatively high strength material for establishing fluid communication between said passageway and the interior of said container, one end of said conduit segment being molded into said body member and the other end extending through said neck opening and into said interior; and fastening means on said tube segment for establishing a mechanically rigid pressure-sealed engagement between said tube segment and said container.

14. A valve assembly as defined in claim 13 wherein said neck opening is internally threaded, and wherein said fastening means include an externally threaded portion on said tube segment.

15. A valve assembly as defined in claim 14 wherein said externally threaded portion comprises an externally threaded collar received over the outside surface of said tube segment.

16. A valve assembly as defined in claim 13 wherein said one end of said tube segment is flared for improved engagement to said plastic valve housing.

17. A valve assembly as defined in claim 13 wherein said tube segment is formed of a metallic material.

* * * * *